US011272826B2

(12) United States Patent
Krieger et al.

(10) Patent No.: US 11,272,826 B2
(45) Date of Patent: Mar. 15, 2022

(54) APPLIANCE DOOR LATCH SYSTEM WITH PRE-LATCHING CATCH ALIGNMENT SYSTEM

(71) Applicant: Illinois Tool Works Inc., Glenview, IL (US)

(72) Inventors: Jeffrey J. Krieger, Mukwonago, WI (US); Nicola Sartori, Comerio (IT)

(73) Assignee: Illinois Tool Works Inc., Glenview, IL (US)

( * ) Notice: Subject to any disclaimer, the term of this patent is extended or adjusted under 35 U.S.C. 154(b) by 677 days.

(21) Appl. No.: 16/010,798

(22) Filed: Jun. 18, 2018

(65) Prior Publication Data

US 2018/0368652 A1 Dec. 27, 2018

Related U.S. Application Data

(60) Provisional application No. 62/524,147, filed on Jun. 23, 2017.

(51) Int. Cl.

| | |
|---|---|
| ***A47L 15/42*** | (2006.01) |
| ***E05C 19/00*** | (2006.01) |
| ***E05C 5/00*** | (2006.01) |
| ***E05C 19/02*** | (2006.01) |
| ***E05B 15/04*** | (2006.01) |

(52) U.S. Cl.

CPC ..... *A47L 15/4259* (2013.01); *E05C 5/00* (2013.01); *E05C 19/009* (2013.01); *E05C 19/02* (2013.01); *E05B 2015/0493* (2013.01); *E05C 2005/005* (2013.01); *E05Y 2900/304* (2013.01)

(58) Field of Classification Search

CPC ..... A47L 15/4259; E05C 5/00; E05C 19/009; E05C 19/02; E05C 2005/005; E05B 2015/0493; E05Y 2900/304; Y10S 292/04; Y10S 292/69

See application file for complete search history.

(56) References Cited

U.S. PATENT DOCUMENTS 2,931,205 A * 4/1960 Schmitz ..... E05B 65/0053 70/92
5,174,618 A * 12/1992 Kropf ..... A47L 15/4259 292/254
5,401,067 A * 3/1995 Kurosaki ..... E05C 5/00 292/63

(Continued)

FOREIGN PATENT DOCUMENTS

CN 101258296 A 9/2008
CN 102597397 A 7/2012

(Continued)

OTHER PUBLICATIONS

EPO Exam Report dated Mar. 26, 2021, for Application No. EP 18 739 693.2-1005.

*Primary Examiner* — Christine M Mills
*Assistant Examiner* — Steven A Tullia
(74) *Attorney, Agent, or Firm* — Boyle Fredrickson, S.C.

(57) ABSTRACT

An appliance door latch system is provided that automatically aligns latching components each time an appliance door is closed with a pre-latching catch alignment system. The pre-latching catch alignment system may include a floating catch carrier that is deflected by a door-mounted latch feature to passively reposition a catch to properly align with the striker assembly.

20 Claims, 14 Drawing Sheets

(56) References Cited

U.S. PATENT DOCUMENTS 6,145,898 A * 11/2000 Onderka ..... D06F 37/42 292/228
6,152,500 A * 11/2000 Kowalewski ..... E05B 83/16 292/216
6,155,616 A * 12/2000 Akright ..... E05B 5/00 292/198
6,290,270 B1 * 9/2001 Spiessl ..... E05C 3/24 292/216
6,390,518 B1 * 5/2002 Elick ..... A47L 15/4259 292/117
7,306,266 B2 12/2007 Hapke et al.
8,733,802 B2 * 5/2014 Promutico ..... D06F 37/28 292/57
9,370,294 B2 * 6/2016 Osvatic ..... E05C 19/02
9,487,976 B2 11/2016 Ala et al.
2005/0194795 A1 9/2005 Hapke
2006/0033346 A1 * 2/2006 Ala ..... A47L 15/4259 292/216
2008/0042447 A1 * 2/2008 Neumann ..... E05C 5/00 292/126
2012/0119522 A1 * 5/2012 Bauriedl ..... E05C 19/024 292/228
2013/0234578 A1 9/2013 Ala
2015/0035295 A1 * 2/2015 Li ..... A47L 15/4259 292/219
2015/0267446 A1 9/2015 Promutico, I
2016/0138809 A1 * 5/2016 Colucci ..... E05C 19/00 292/122
2017/0188785 A1 * 7/2017 Park ..... E05C 19/02

FOREIGN PATENT DOCUMENTS

DE 102004061231 B3 * 4/2006 ..... F24C 15/022
DE 102011075554 A1 * 11/2012 ..... A47L 15/4259
EP 1304436 A1 4/2003
EP 1469147 A2 * 10/2004 ..... E05B 47/023
EP 2643535 10/2013
GB 2193525 A * 2/1988 ..... E05C 3/24
GB 2193525 A 2/1988
WO WO-2006111501 A1 * 10/2006 ..... E05B 63/20
WO WO-2008096222 A2 * 8/2008 ..... D06F 39/14
WO WO-2014061044 A2 * 4/2014 ..... E05C 19/12

* cited by examiner

APPLIANCE DOOR LATCH SYSTEM WITH PRE-LATCHING CATCH ALIGNMENT SYSTEM

CROSS-REFERENCE TO RELATED APPLICATIONS

This application claims the benefit of U.S. provisional application 62/524,147 filed Jun. 23, 2017 and is hereby incorporated by reference.

FIELD OF THE INVENTION

The present invention relates to home appliances such as dishwashers and front-loading washing machines which may have access doors with latching mechanisms and to an appliance door latch system that provides consistent and quiet operation while accommodating door height variation.

BACKGROUND OF THE INVENTION

Appliances such as dishwashers and front-loading washing machines may have front access doors and latches that hold the doors shut to compress door gaskets to seal water within washing chambers of the appliances. In order to eliminate the need for a latch handle, it is known to use an over-center spring mechanism in an appliance door latch that toggles between a stable closed position and a stable open position when the door is pushed closed and pulled open. U.S. Pat. Nos. 9,487,976 and 7,306,266, assigned to the present assignee and hereby incorporated by reference, describe appliance door latches.

Appliance door height can vary between units, even within the same appliance model line. This is due to manufacturing and production or assembly variations. The variations include component size variations and alignment variations during assembly that collectively provide tolerance stack-ups. Door height variations can cause corresponding relative position variations between latch components such as latch strikers and latch cams or catches, which can lead to misalignment-related latching performance issues.

In order to accommodate these variations in latch component positions, the latch cams are typically made large with large slots that provide a relatively loose fit that are still operable despite potential component misalignment(s). Accordingly, the large and loose-fitting latch cams ensure that the latch cams can receive the strikers regardless of their assembled position(s). However, large latch components limit their mounting location options.

Over-center spring mechanisms are typically used to actuate latch cams, with springs that are energized as the doors are opened. However, when the springs release their energy as the doors close, loose-fitting latch cams can produce loud noises. That is because the large clearances between the strikers and cam surfaces in loose-fitting latch cams allow the over-center spring mechanisms to accelerate the closing rotation of the latch cams to speeds that allow the latch cams to collide with the striker with enough force to generate loud slapping or clunking noises.

SUMMARY OF THE INVENTION

The present invention provides an appliance door latch system that handles tolerance stack-ups and/or other manufacturing and production or assembly variations with small interacting components that provide a compact configuration that improves mounting placement and results in quiet operation.

Specifically, in one embodiment, the invention provides an appliance door latch system with a door-mounted latch feature such as a striker assembly or a receptacle supported by an appliance door. The striker assembly includes a striker that moves with the door toward and away from an appliance housing when the appliance door is moved between door closed and open positions. A latch mechanism receives the striker or other door-mounted latch feature(s) to secure the appliance door in the door closed position and releases the striker to release the appliance door when the door is opened. The latch mechanism includes a catch that selectively engages the striker or other door-mounted latch feature(s) for holding the appliance door in the door closed position. A pre-latching catch alignment system supports the catch and aligns the catch relative to the door-mounted latch feature(s) while the door is moved from the door open position toward the door closed position.

It is, thus, a feature of at least one embodiment of the invention to provide a mechanism for automatically aligning appliance door latch components.

The pre-latching catch alignment system may include a floating catch carrier that supports the catch. At least a portion of the floating catch carrier is movable with respect to the appliance housing when the floating catch carrier and/or catch engages the striker assembly or other door-mounted latch feature(s). The floating catch carrier may lift upwardly to accommodate the striker passing under the catch during an appliance door latching event in which the striker or other door-mounted latch feature(s) is inserted into the latch mechanism. The floating catch carrier may include an inner end that faces away or is further from the appliance door and an outer end that faces or is closer to the appliance door. The floating catch carrier outer end may provide the height-adjusting movement by pivoting upwardly when the striker passes under it during the appliance door latching event.

The floating catch carrier may be spring biased to a first position against a stop and includes a sloped guide surface receiving a feature of the striker assembly or, for example, a surface of door itself, to move the floating catch carrier away from the stop against the spring biasing to position the catch carrier into alignment with the striker or other door-mounted latch feature(s) as the door is closed. The surface or feature may be offset a predetermined distance from the reminder of the striker or door-mounted latch feature(s). In a striker implementation of the door-mounted latch feature, this may include being offset from the striker toward the floating catch carrier to bring the catch carrier into alignment before the catch reaches the striker.

It is, thus, a feature of at least one embodiment of the invention to provide components with cooperating configurations to align the catch to the door-mounted latch feature(s) before they contact each other, such as before a catch-to-striker contact.

It is, thus, a feature of at least one embodiment of the invention to provide a mechanically simple mechanism for aligning appliance door latch components by way of a floating component(s) that is pushed into a correct position during a door latching event.

The catch may be a pawl with a pawl body that is connected to the floating catch carrier and a pawl claw that extends from the pawl body. The pawl claw may selectively engage a receptacle as the door-mounted latch feature(s) to latch the appliance door in the door closed position. The pawl may be movable between a pawl lowered position and a pawl raised position. When in the pawl lowered position, a tip of the pawl claw may extend downwardly beyond a lower surface of the floating catch carrier, such as a bottom wall of the floating catch carrier, to define a first tip position. When in the pawl raised position, the tip of the pawl claw may define a second tip position that is raised relative to the first tip position, such as at the same height or higher than the bottom wall of the floating catch carrier. The pawl may move from the pawl lowered position to the pawl raised position to accommodate an upper door edge or other surface or feature that moves in unison with the door passing under the floating catch carrier during an appliance door unlatching event in which the door-mounted latch feature(s) is withdrawn from the latch mechanism. The pawl may be pivot-mounted to the floating catch carrier so that the pawl pivots between the lowered and raised positions. The pawl may be biased toward the pawl lowered position and, therefore, in a normally lowered position. The pawl may be movable between retracted and extended positions. When in the retracted position, the pawl body is arranged relatively farther inward relative to the appliance housing or away from the door. When in the pawl extended position, the pawl body is arranged relatively farther outward relative to the appliance housing or moved outwardly from the retracted position. A translation joint between the pawl and the floating catch carrier may allow relative movement between the pawl and the floating catch carrier and guide the movement of the pawl between the pawl retracted and extended positions. The translation joint may include a slot that extends longitudinally along the floating catch carrier and provides a pathway along which the pawl moves. A pin may extend transversely through and be mounted to move longitudinally within the slot in the floating catch carrier to connect the pawl to the floating catch carrier at the translation joint. The pin may also define a pivot axis of the pawl to allow the pawl to move both longitudinally and pivotally with respect to the floating catch carrier. The pawl may be biased toward the retracted position so that the pawl is normally retracted in a seated position.

It is, thus, a feature of at least one embodiment of the invention to provide a catch of simple construction, such as a pawl, that can default to a latched position and be pulled away from the latched position during the unlatching event.

In another embodiment, the invention provides a dishwasher with a height-correcting latch mechanism adapted to receive a striker or other door-mounted latch feature(s) to secure the appliance door in the door closed position and release the striker to release the appliance door to permit movement of the appliance door to the door open position. The latch mechanism may include a catch and a floating catch carrier that support the catch and at least a portion of which is movable with respect to the appliance housing. This may automatically provide height adjustment of the catch to vertically align the catch with the striker or other door-mounted latch feature(s) during a door-latching event in which the striker or other door-mounted latch feature(s) is inserted into the latch mechanism.

It is, thus, a feature of at least one embodiment of the invention to provide a dishwasher with an automatic height-adjusting door latch system of simple construction.

In another embodiment, the appliance door latch system may include an over-center spring mechanism, a cam-type catch, and a floating catch carrier implemented as a floating cam carrier that automatically moves the cam to a position that properly aligns a cam with a striker or other door-mounted latch feature(s) during a latching event, regardless of the striker's position. The floating cam carrier includes an alignment block that, during a latching event, contacts the striker assembly or other door-mounted latch feature(s) before the cam and slides across the striker assembly or other door-mounted latch feature(s) to deflect the floating cam carrier and automatically align a cam opening with the striker or other feature to provide a constant height between the cam and door-mounted latch feature. This ensures consistent points of engagement between cams and strikers or other latch features despite differences in relative positions caused by manufacturing and production or assembly variations, which allows for providing cams and strikers or other door-mounted latch features with tighter fits. Cams and strikers or other door-mounted latch features that fit tighter against each other produce less noise during latching events. The invention may also ensure proper alignment of close-fitting cams and strikers or other door-mounted latch features by ensuring consistent points of engagement even though latch component positions may have changed over time due to such things as component wear in appliance door hinges or other system joints or changes in compliance or other wear characteristics of door gaskets. By ensuring consistent cam-to-striker or other feature alignment by passively adjusting cam height to a proper height relative to the striker or other feature, smaller cams can be implemented that provide shorter overall latch assembly heights, permitting installation in locations that would otherwise be challenging, such as between the top of a washer tub and an underside of a countertop surface.

It is, thus, a feature of at least one embodiment of the invention to provide a catch of simple construction, such as a cam, that automatically vertically floats to reposition the cam for proper alignment during a latching event.

Other features and advantages of the invention will become apparent to those skilled in the art upon review of the following detailed description, claims, and drawings in which like numerals are used to designate like features.

Figure 1:
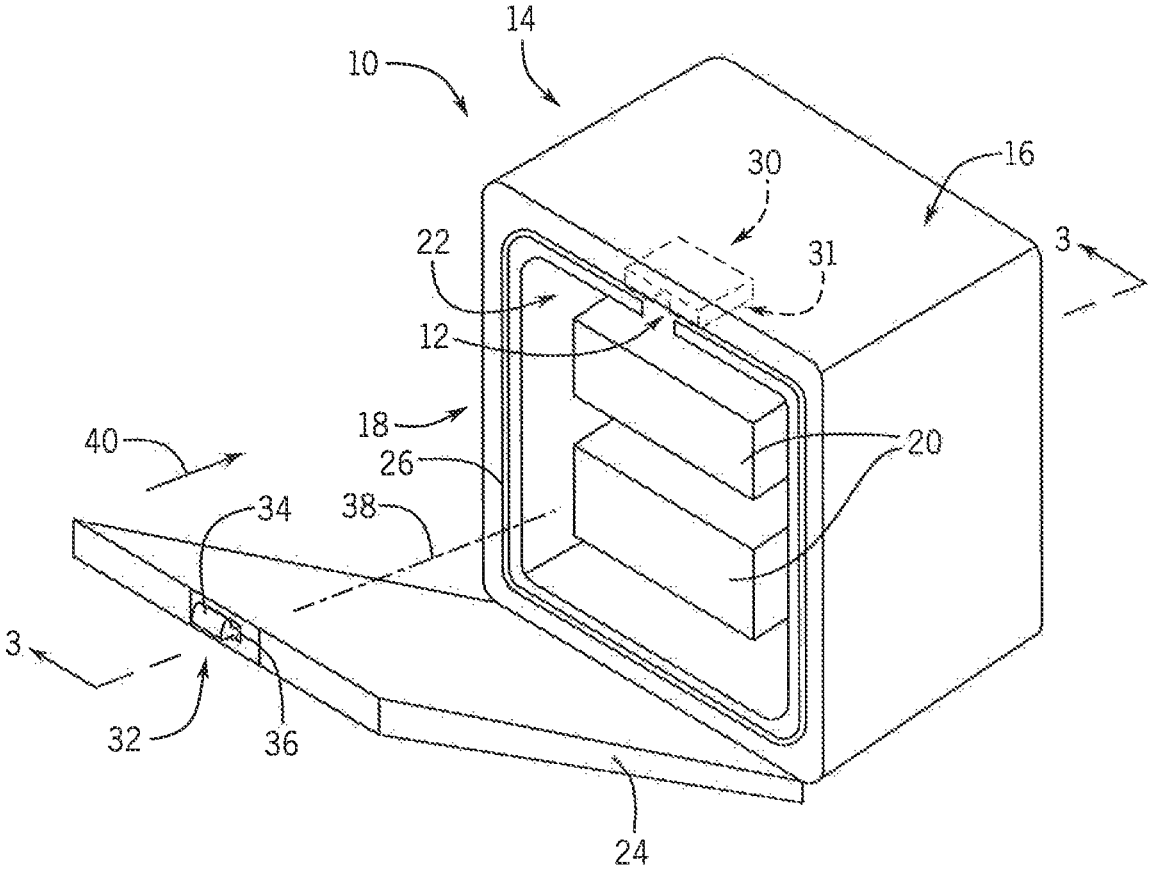
FIG. 1 is a simplified isometric view of an appliance that incorporates the appliance door latch system with a pre-latching catch alignment system.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof, as well as additional items and equivalents thereof.

DETAILED DESCRIPTION OF THE PREFERRED EMBODIMENTS

Referring now to FIG. 1, an appliance 10 is shown incorporating an appliance door latch system 12. Appliance 10 is shown here as dishwasher 14, although it is understood that appliance door latch system 12 may be provided on a different type of appliance 10, such as a washing machine. Appliance 10 includes a housing 16, such as a dishwasher housing when the appliance 10 is a dishwasher 14, that may have a front opening 18. In the case of a dishwasher 14, front opening 18 exposes one or more dish racks 20 for holding dishes or the like for washing within an inside space or housing volume 22. A door 24 may be hingeably attached to the front of the housing 16 to seal against the front of the housing 16 by compressing intervening peripheral gasket 26 encircling the front opening 18.

Appliance door latch system 12 has cooperating components arranged at housing 16 and door 24, including latch mechanism 30 that is mounted to housing 16 and door-mounted latch feature shown here as a striker assembly 32 that is mounted to door 24. Latch mechanism 30 may have a latch mechanism housing 31 as an enclosure that surrounds the components of the latch mechanism while permitting various latch mechanism 30 components to interact with the striker assembly 32, such as through an opening in a front wall of the latch mechanism housing 31. Striker assembly 32 includes striker 34 that may be a projection, such as a pin or the like, shown here with necked-down narrower lowering intermediate sections and wider outer or top end that presents a generally T-shaped form in cross-section. Striker 34 may extend upwardly from a striker plate 36, shown here with a rounded front edge, at an upper end or edge of door 24. Striker 34 is received in the latch mechanism 30, explained in greater detail elsewhere herein, along a horizontal axis 38 in a receiving direction 40 (parallel to horizontal axis 38). Once so received, striker 34 is retained within latch mechanism 30 to hold the door 24 in a closed position during the washing cycle with a sealing compression of the gasket 26.

Figure 2:
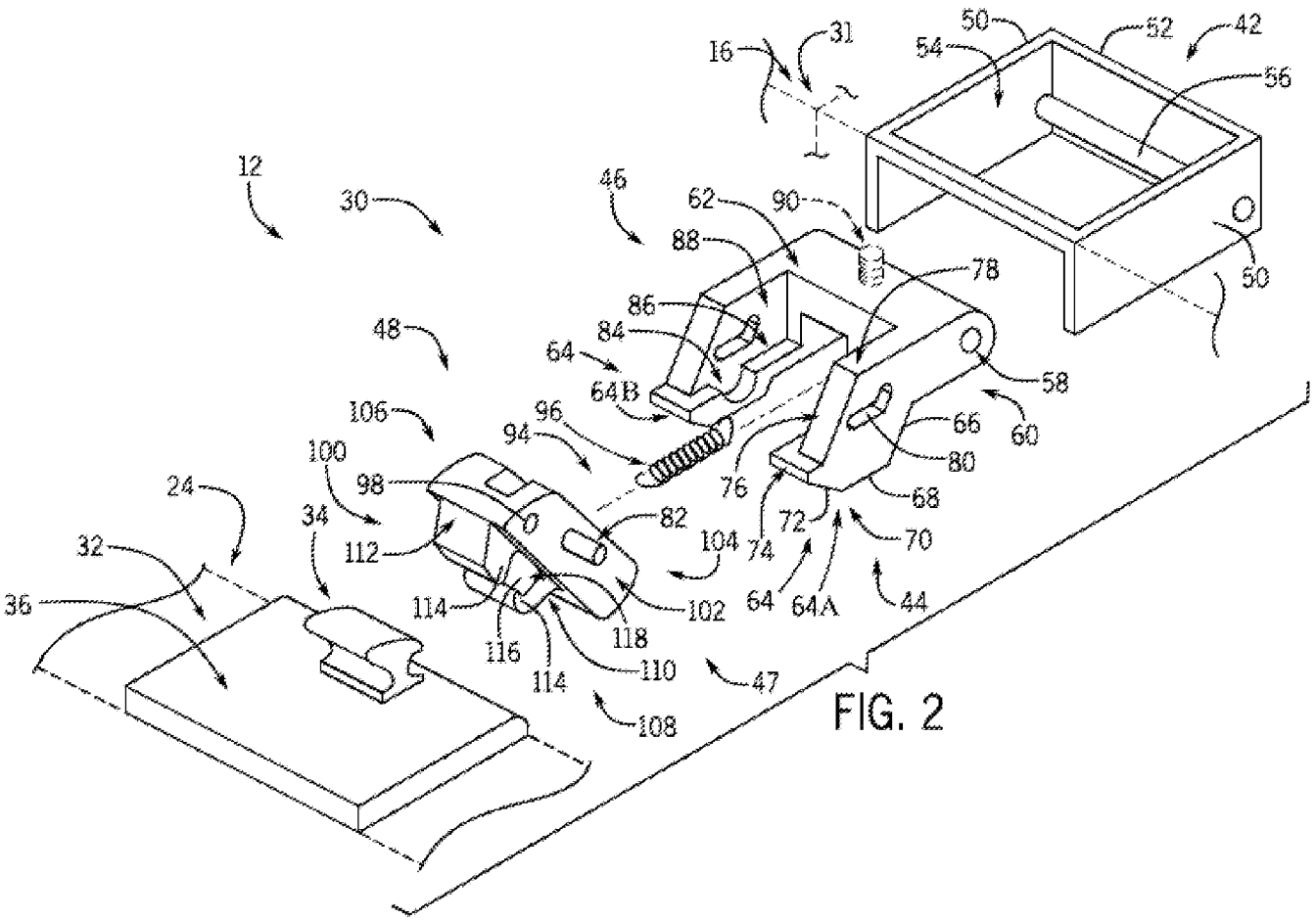
FIG. 2 is an exploded isometric view of a first embodiment of the appliance door latch system of FIG. 1.

Referring now to FIG. 2, a first embodiment of a latch mechanism 30 is shown here with its components that may be enclosed by the latch mechanism housing 31 (FIG. 1). The latch mechanism 30 may include a latch frame shown as latch base 42 that supports a pre-latching alignment system 44, represented here as a cam pre-engagement or cam pre-latching alignment system. The pre-latching alignment system 44 may include a swing arm or floating catch carrier 46 that carries a catch 47 for engaging the striker 34 to latch the appliance door closed. Catch 47 is shown here with a cam configuration as cam 48. The pre-latching alignment system 44 automatically vertically aligns and provides a constant relative height between cam 48 and striker 34 during latching events in which door 24 closes and latches shut. Latch base 42 may be mounted in a forward-facing edge of a top wall of housing 16. Latch base 42 has a boxlike configuration with interconnected walls shown as side walls 50 and back wall 52 that extend about the respective portions of a latch base interior 54. A pin 56 extends through the latch base interior 54, near back wall 52 and between side walls 50, and extends into a bore(s) 58 toward the back of a catch carrier body 60 of the floating catch carrier 46 to define a pivot joint that pivotably holds the floating catch carrier 46 in the latch base interior 54. The pre-latching alignment system 44 therefore provides the latch mechanism 30 and striker assembly 32 with features that engage and cooperate through various, for example, sliding interfaces that facilitate pre-alignment of the catch 47 to the striker 34 before they collide with each other during active latching.

Still referring to FIG. 2, catch carrier body 60 is shown having base segment 62, through which bore 58 extends. Base segment 62 is arranged toward the back of and extends across the width of catch carrier body 60. At least one alignment block, generally referred to as alignment block 64, is shown here as a pair of for first and second alignment blocks 64A, 64B, which are arranged toward the front of catch carrier body 60. The alignment blocks 64A, 64B are shown transversely spaced from each and extend longitudinally from and lower than base segment 62 to provide a downward and forward-extending forked configuration to a front end of the catch carrier body 60. Alignment blocks 64A, 64B, may be identical to each other. Only features of the lower-positioned (as shown in FIG. 2) or first alignment block 64A are labeled, but are applicable to the upper-positioned (as shown in FIG. 2) or second alignment block-64B. Each alignment block 64A may include a back lower surface 66 that extends angularly down from base segment 62. An intermediate bottom surface 68 of alignment block 64A extends from a front edge of back lower surface 66. Alignment ramp 70 is shown defined by a front lower surface 72 of alignment block 64A that connects at its front end to shelf 74 that has a forward-facing surface and an upper surface. Front upper surface 76 extends angularly up and rearward from shelf 74 and connects to the top wall 78 of alignment block 64A.

Still referring to FIG. 2, each alignment block 64 is shown with a slot 80 that is configured to hold and guide a pin 82 of cam 48 to movement of cam 48 in a longitudinal direction and angularly up and back toward the back of slot 80. This provides a rearward and upward sliding movement path of cam 48 to push back and climb up and over striker 34 for permitting latching, if the cam 48 is improperly in a pivoted-down closed position before closing the door 24 instead of a proper pivoted-up open position as shown in FIG. 2. Pins 82 extend through slots 80 and define a translation joint along which the cam 48 can advance and retract relative to the catch carrier 46. Slots 80 are shown here with forward generally horizontal segments and rear angled segments that extends angularly back and upward from the forward slot segments. The catch carrier body 62 has various features that provide stops and movement guides that cooperate with corresponding features of the cam 48 to, for example, prevent the latch rotation at various states of operation and provide discrete cam 48 positions and guide its movement between unlatched and latched positions. Below slots 80, carrier sockets 84 may be defined in the catch carrier body 62, shown here extending downwardly into inner carrier shelves 86 of the alignment blocks 64 that may extend longitudinally along the alignment blocks 64 and transversely inward, into a space 88 between the alignment blocks 64. Sockets 84, only one of which is visible in FIG. 2, may have generally V-shaped configurations and may have straight front socket walls that extend angularly back and down from the top surface of the shelves 86 and curved back socket walls that extend from the bottom edge of the front socket wall upward to the shelves 86. The angles and contours of the sockets 84 may match those of surfaces of the back and bottom wall segments of the cam 48 so that the back of cam 48 can nest in the sockets 84 and angle upwardly from the catch carrier 46 when in an open or unlatched state. To achieve a closed or latched state, the cam 48 is rotated downwardly about pins 82 to a tripped position and the pins 82 move rearwardly through the slots 80 while the cam 48 is retracted into the interior space 88. Movement of the cam 48 from its initially tripped position to its fully closed or latched position is guided by cooperating sliding surfaces, such as the lower surface or bottom wall of cam 48 that interfaces with and slides over the shelves 86. This engagement between the bottom wall of cam 48 and the carrier shelves 86 further provides and anti-rotation feature that prevents the cam 48 from rotating until it is again pulled outwardly to an extended position, which allows the back of the cam 48 to clear the rear segment(s) of the shelves 86 and rotate down into the catch socket(s) 84. Spring 90 is arranged at a top surface of carrier body base segment 62 for biasing the floating catch carrier 46 to pivot downwardly about a pin 56, in a default state, whereby, at rest and when unlatched, the floating catch carrier 46 is pivoted down by spring 90, shown as a compression spring, and the back of cam 48 is nested within the sockets 84. This may allow the floating catch carrier 46 may be spring biased, for example by spring 90, to a first position such as a downward position against a stop. The sloped guide surface of the alignment ramp 70 receives a feature of the striker assembly 32 to move the floating catch carrier 46 away from the stop against the spring biasing to position the floating catch carrier 46 into alignment with the striker 34 as the door 24 is closed, which may be before engagement of the cooperating components that latch as a pre-engagement alignment.

Still referring to FIG. 2, latch mechanism 30 is shown with over-center spring mechanism 94 that includes spring 96, shown as a tension spring. Over-center spring mechanism 94 is configured to operate the cam 48 in a bi-stable mode in which the cam 48 has two stable states which positions are defined by the cam 48 pivoted up into an open or unlatched position and the cam 48 pivoted down into a closed or latched position. To provide the bi-stable operation, a front end of spring 96 is connected to cam 48 beyond its pivot axis defined by pins 82, shown here as connected to spring pin 98, and a back end of spring 96 is connected behind cam 48, such as pin 56.

Still referring to FIG. 2, cam 48 includes cam body 100 with a pair of sides 102 (only one of which is visible in FIG. 2) from which pins 82 extend, and back and front ends 104, 106 respectively facing toward and away from back wall 52 of latch base 42. Cam body 100 has a top and an opposite bottom, with a clasp 108 extending from the bottom of cam body 100. Clasp 108 includes back tooth 110 and front tooth 112 that are spaced from each other and each of which may have a projection 114 facing inwardly to define a clasp opening 116 between the projections 114. Clasp opening 116 permits access into a clasp interior space 118 between the back and front teeth 110, 112. A perimeter shape of 118 corresponds to a perimeter shape of striker 34 so that striker 34 can nest tightly in the clasp 108. The height of the clasp opening 116 relative to alignment block intermediate bottom surface 68 may correspond to a height of striker 34 relative to striker plate 36 so that a floating action of floating catch carrier 46 allows for passive vertical (re)positioning of cam 48, if needed, by face-to-face sliding abutment of the alignment block 64 and striker 34 to ensure receipt of striker 34 into the clasp interior space 118 through clasp opening 116.

Referring generally to FIGS. 3-12, various door closing and latching sequences are shown that illustrate how appliance door latch system 12 accommodates variation and striker height with pre-latching alignment system 44 by passively adjusting a height of cam 48 relative to striker 34 to provide a constant relative height between cam 48 and striker 34 before their engagement during latching events. FIGS. 3-7 represent an extreme low position of door 24 and striker 34, such as with the door 24 and striker 34 assembled in their lowest possible position according to manufacturing and assembly variations with typical tolerances. FIGS. 8-12 represent an extreme high position of door 24 and striker 34, such as with the door 24 and striker 34 assembled in their highest possible position according to manufacturing and assembly variations with typical tolerances.

Figure 3:
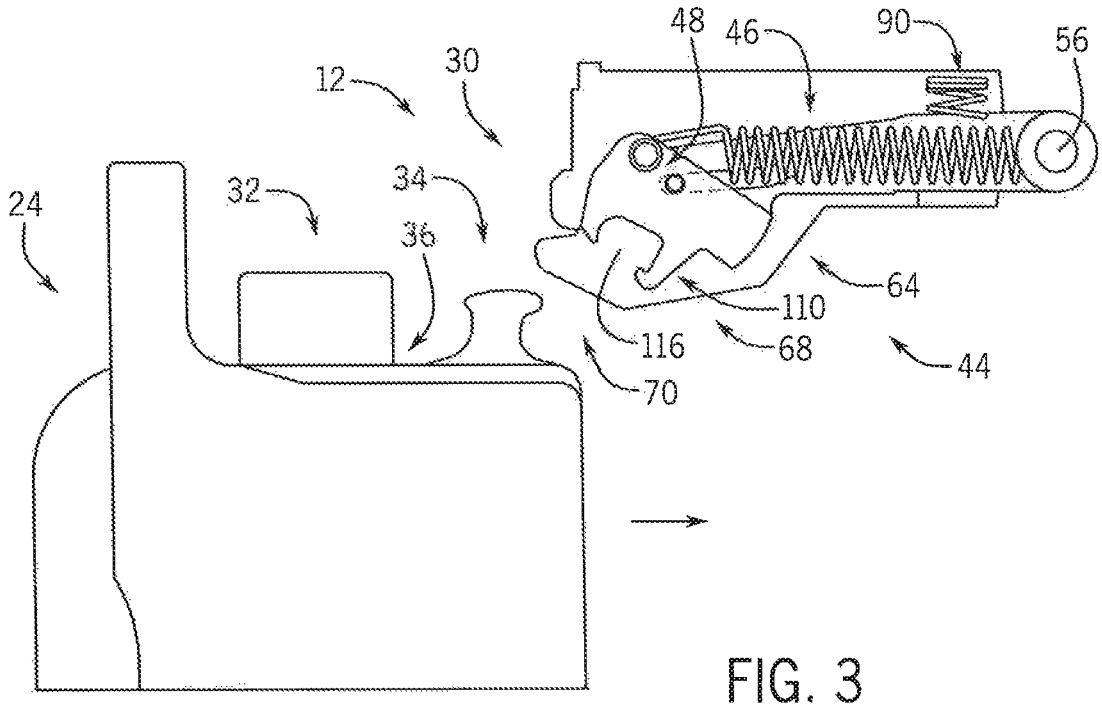
FIG. 3 is a cross-sectional view of the appliance door latch system of FIG. 2 with a first mounting height variation of a striker assembly and an unlatched cam.
Figure 4:
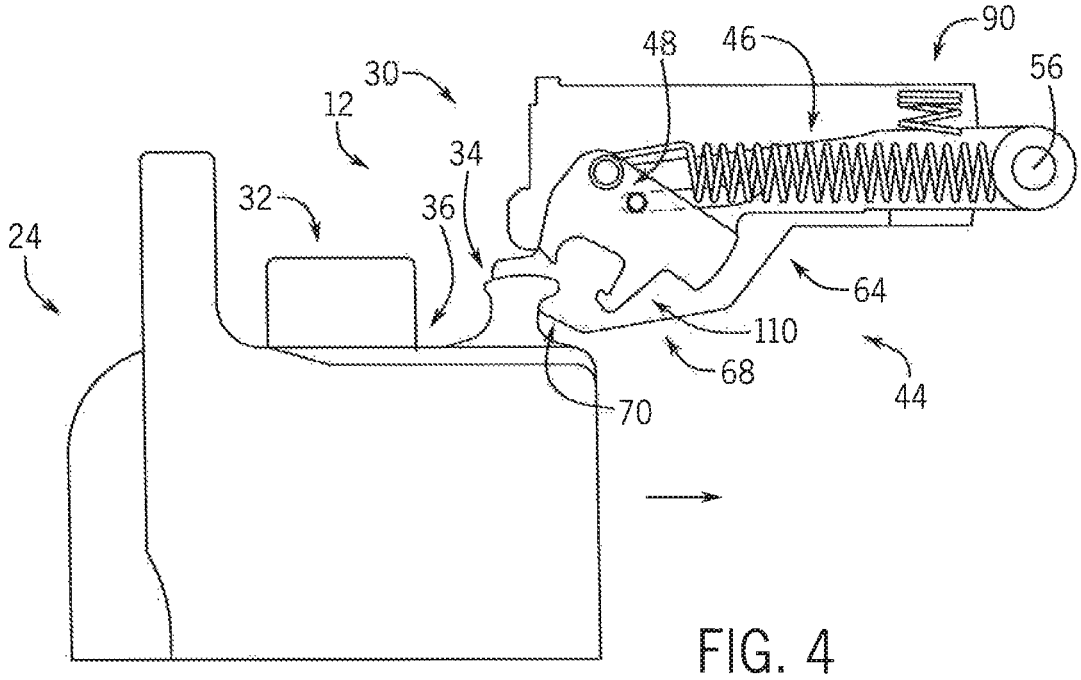
FIG. 4 is another cross-sectional view of the appliance door latch system of FIG. 3 with the door advanced farther toward a closed and latched position.
Figure 5:
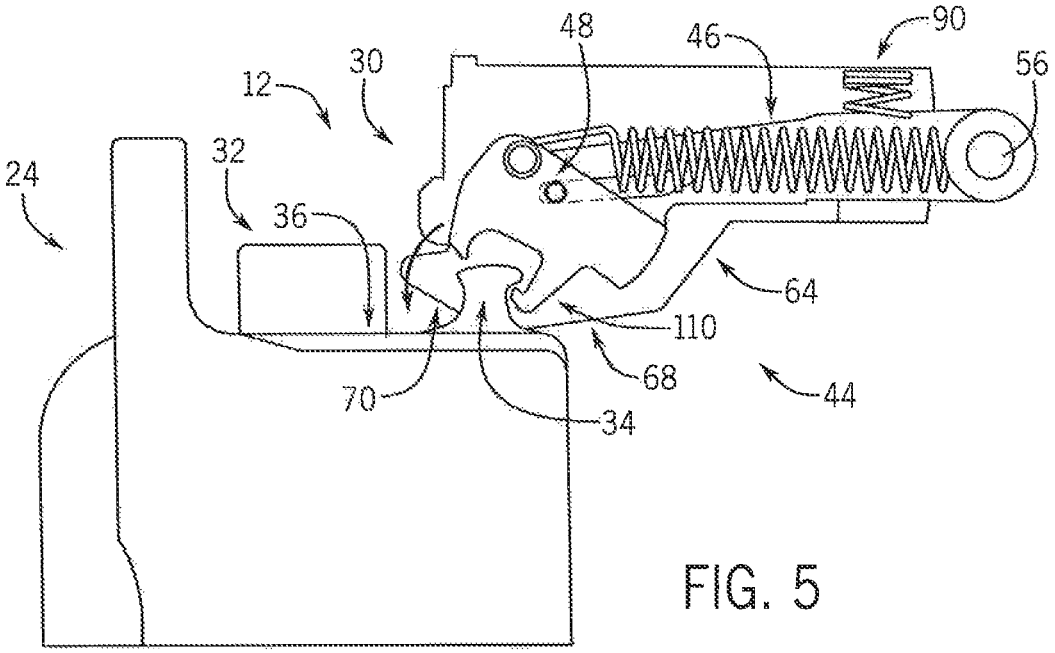
FIG. 5 is another cross-sectional view of the appliance door latch system of FIG. 3 with the door advanced yet farther toward a closed and latched position.
Figure 6:
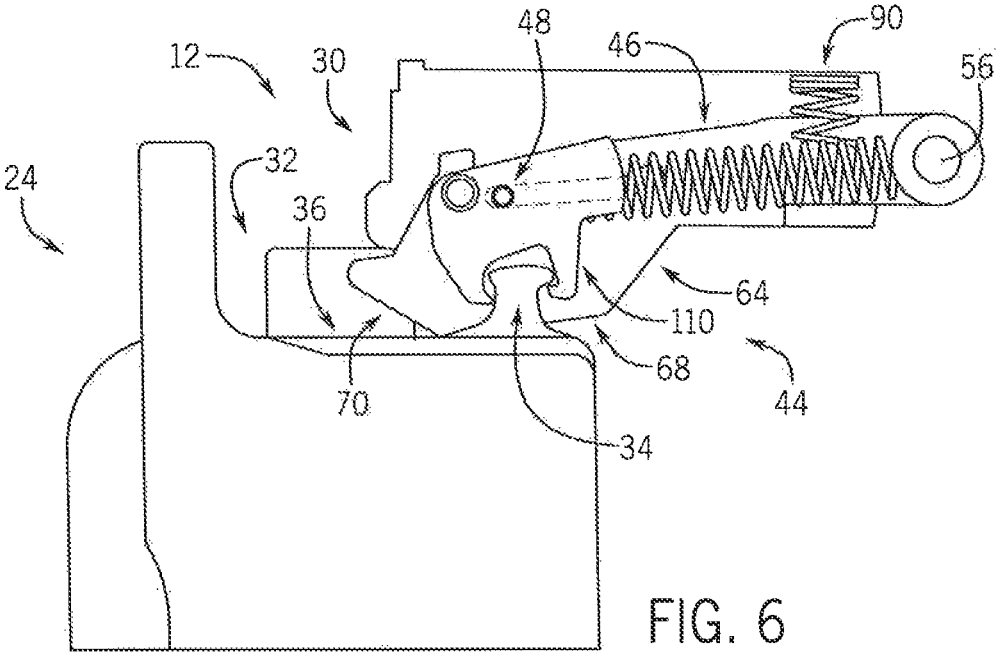
FIG. 6 is another cross-sectional view of the appliance door latch system of FIG. 3 with the door advanced yet farther toward a closed and latched position.
Figure 7:
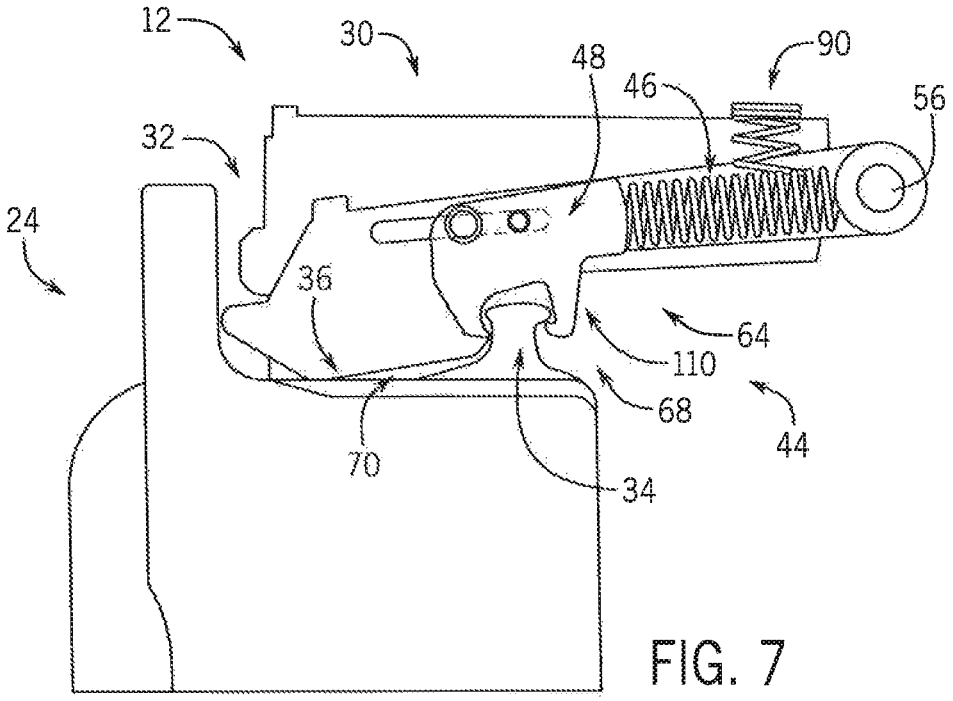
FIG. 7 is another cross-sectional view of the appliance door latch system of FIG. 3 with the door in a fully closed and latched position.

Referring now to FIGS. 3-7 a latching event is shown with door 24 and/or striker 34 in their lowest positions. In this configuration, pre-latching alignment system 44 may operate without the floating catch carrier 46 passively adjusting the height of cam 48. FIG. 3 shows that while closing door 24, cam 48 is in its stable open or unlatched position. FIG. 4 shows that striker plate 36 passes slightly underneath or makes grazing contact with alignment block(s) 64, such as at an edge defined by the intersection of the intermediate bottom surface 68 and ramp 70. FIG. 5 shows door 24 closing farther, with striker 34 making the initial contact with cam 48 at the cam back tooth 110. FIG. 6 shows door 24 after closing yet farther to its closed and latched position. Striker 34 is pushed against the cam back tooth 110 far enough to pivot cam 48 to its downward and stable closed or latched position. During this latching event, alignment block(s) 64 contact striker plate 36 before engagement of striker 34 and cam 48 without appreciable deflection of floating catch carrier 46 so that cam 48 remains in substantially the same height position during the latching event and the striker 34 is substantially aligned with the clasp opening 116 (FIG. 3) at the beginning of the latching event. FIG. 7 shows door 24 in a fully closed position, with the cam 48 moved rearwardly further into the floating catch carrier 46, as guided by pins 82 (FIG. 2) sliding through the slots 80 (FIG. 2). An unlatching event occurs in the opposite order, with the cam 48 slid forward through the floating catch carrier 46 and then rotated in the opposite direction to return to its stable open or unlatched position.

Figure 8:
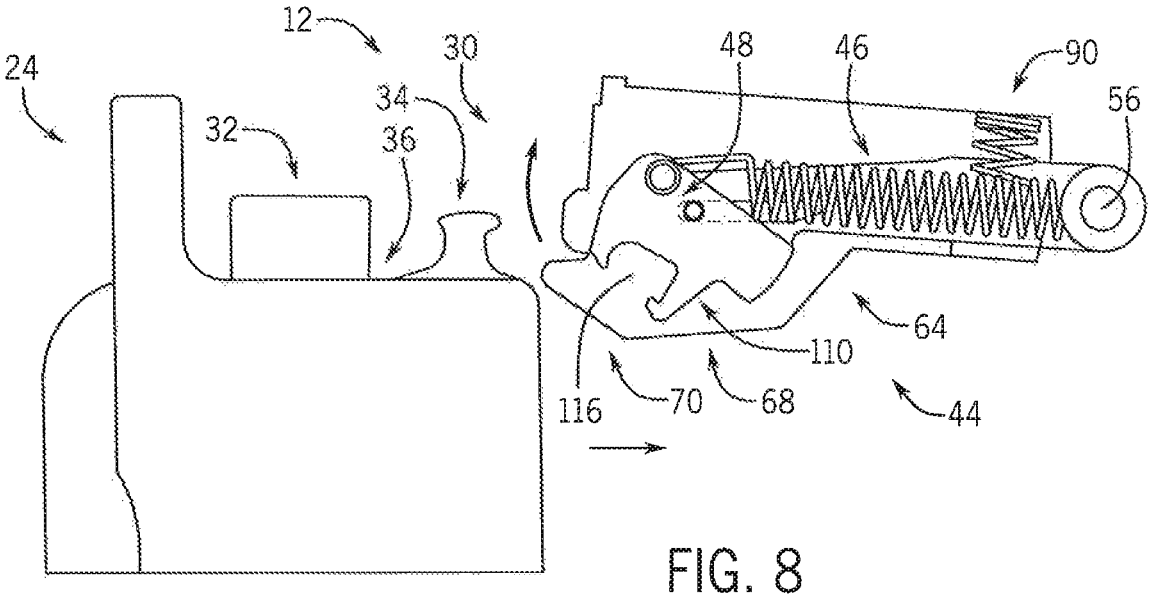
FIG. 8 is a cross-sectional view of the appliance door latch system of FIG. 2 with a second mounting height variation of a striker assembly and an unlatched cam.
Figure 9:
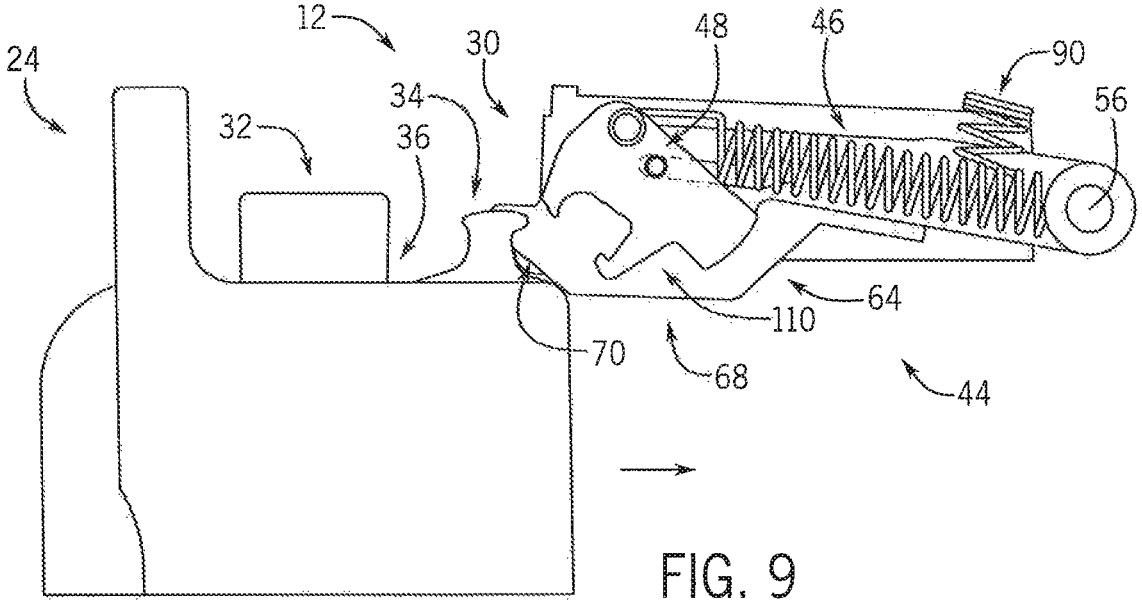
FIG. 9 is another cross-sectional view of the appliance door latch system of FIG. 8 with the door advanced farther toward a closed and latched position.
Figure 10:
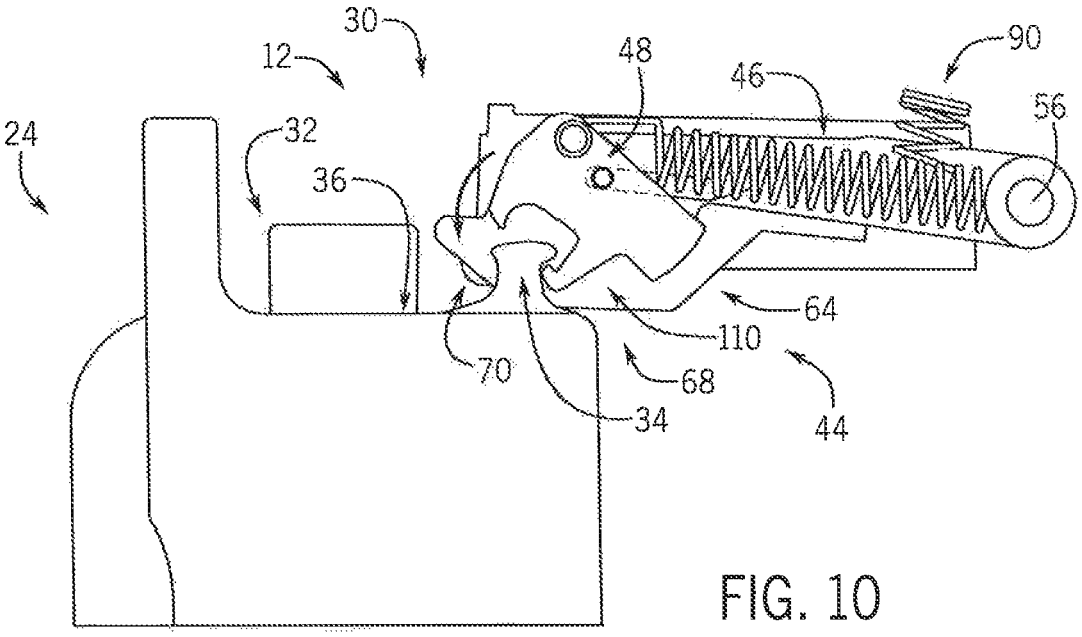
FIG. 10 is another cross-sectional view of the appliance door latch system of FIG. 8 with the door advanced yet farther toward a closed and latched position.
Figure 11:
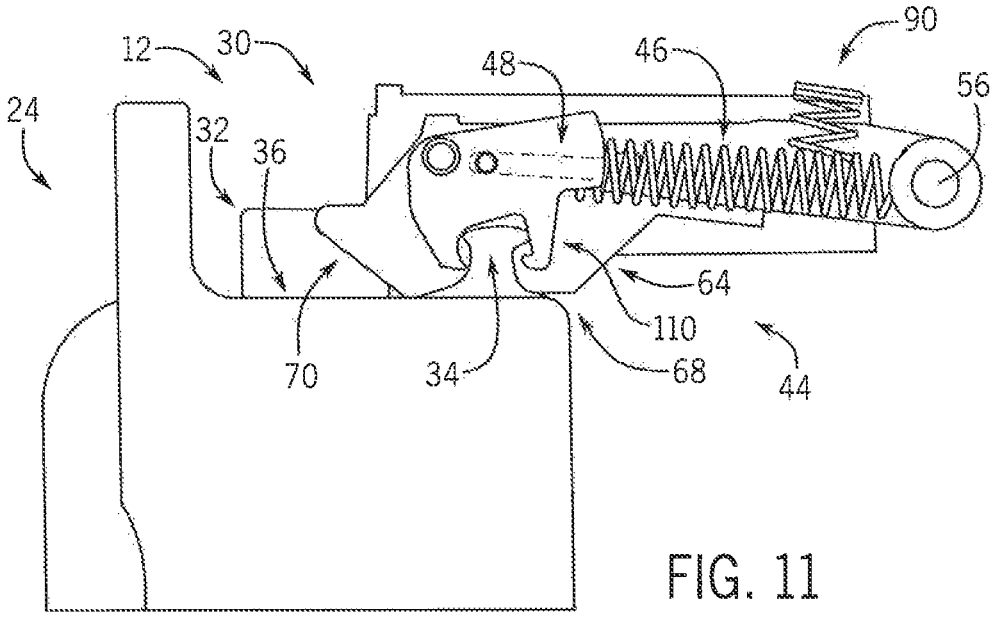
FIG. 11 is another cross-sectional view of the appliance door latch system of FIG. 8 with the door advanced yet farther toward a closed and latched position.
Figure 12:
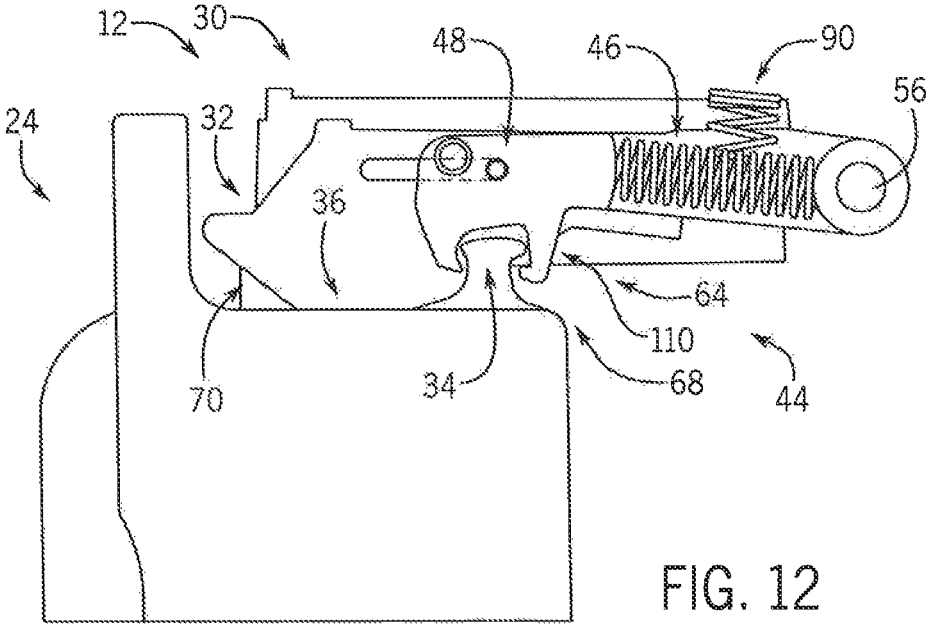
FIG. 12 is another cross-sectional view of the appliance door latch system of FIG. 8 with the door in a fully closed and latched position.

Referring now to FIGS. 8-12, a latching event is shown with door 24 and striker 34 in their highest positions. In this configuration, pre-latching alignment system 44 may operate with the floating catch carrier 46 passively adjusting the height of cam 48 to automatically lift the cam 48 to match the height of striker 34 before the cam 48 and striker 34 engage. The description of FIGS. 3-7, with respect to the lowest mounting position(s) of door 24 and/or striker 34, is applicable here with respect to FIGS. 8-12 with the highest mounting position(s) of door 24 and/or striker 34, only differs in the following ways. FIG. 8 shows vertical misalignment of striker 34 and cam 48. Striker 34 is positioned too high to be directly received into clasp opening 116. As door 24 is closed farther, the rounded leading edge of striker plate 36 contacts ramp 70, shown here with a point of initial contact toward the outer end of ramp 70 near shelf 74. A comparison of the positions of alignment block 64 in FIGS. 8 and 9 show that closing the door 24 farther from the point of initial contact between striker plate 36 and ramp 70 lifts the alignment block 64 through sliding contact as striker plate 36 slides across ramp 70, farther under alignment block 64. This lifts the cam 48 upwardly by deflecting the floating catch carrier 46 to pivot upwardly about pin 56 while overcoming the biasing force of and compressing the spring 90. Movement from the position(s) of FIG. 9 to that of FIG. 10 shows that, as door 24 continues to close, striker 34 advances toward cam 48, and an upper surface of striker plate 36 slides in face-to-face abutment under the alignment block intermediate bottom surface 68, and the floating catch carrier 46 may pivotally deflect upward slightly farther and striker 34 makes initial contact with cam 48 at the cam back tooth 110. FIG. 11 shows door 24 after closing yet farther to its closed and latched position. Striker 34 is pushed against the cam back tooth 110 far enough to pivot the cam 48 to its downward and stable closed or latched position. During this latching event, alignment block(s) 64 guide a passive height adjustment of cam 48 by engaging striker plate 36 before engagement of striker 34 and cam 48 and lifting the floating catch carrier 46 to pivot upwardly into a position that aligns striker 34 with the clasp opening 116 (FIG. 7) of cam 48. FIG. 12 shows door 24 in a fully closed position, with the cam 48 moved rearwardly further into the floating catch carrier 46, as guided by pins 82 (FIG. 2) sliding through the slots 80 (FIG. 2). Here again, the unlatching event occurs in the opposite order, with the cam 48 rotated in the opposite direction to return to its stable open or unlatched position.

Figure 13:
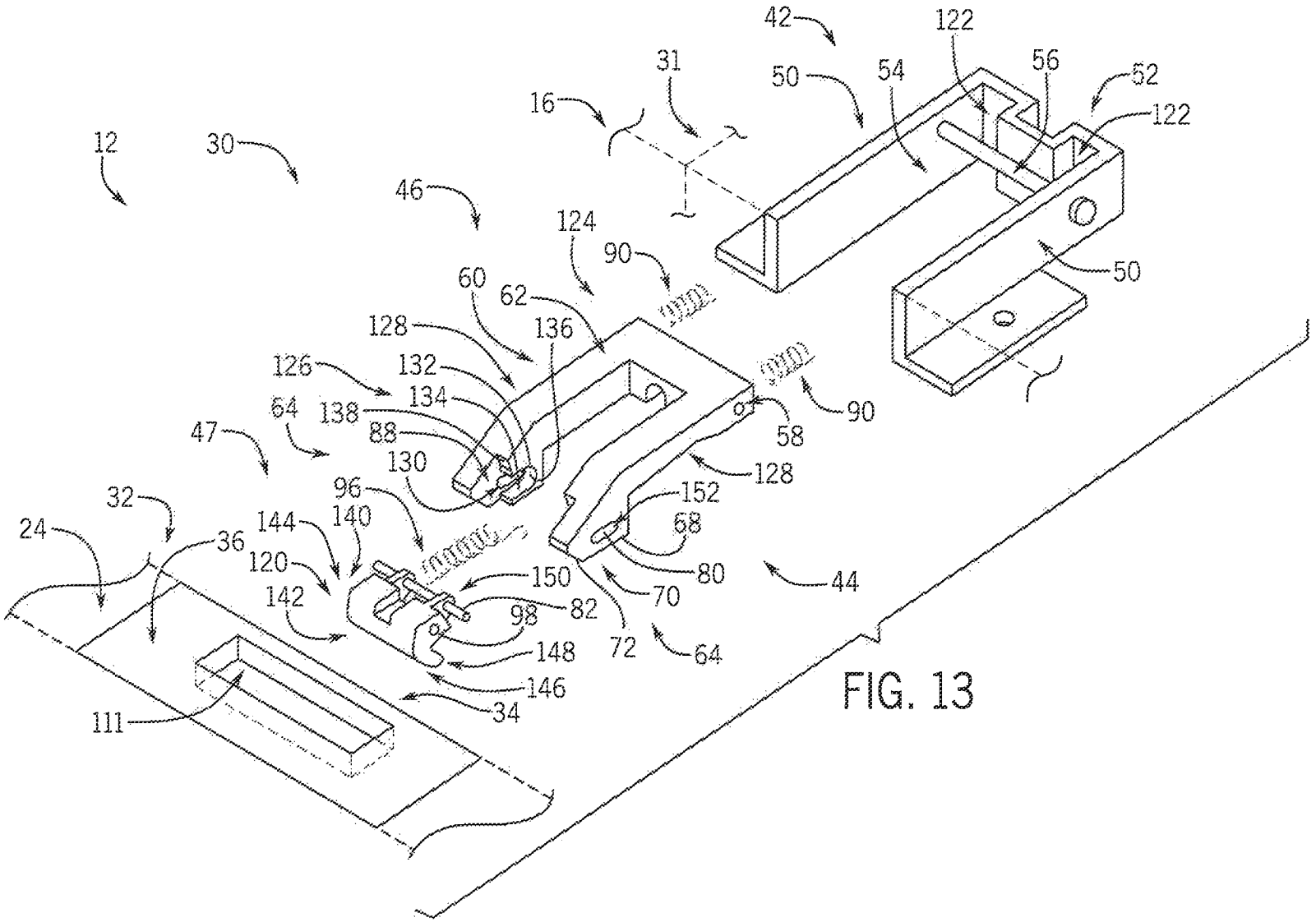
FIG. 13 is an exploded isometric view of a second embodiment of the appliance door latch system of FIG. 1.

Referring now to FIG. 13, a second embodiment of latch mechanism 30 and a second embodiment of striker assembly 32 are shown. Instead of the door-mounted latch feature having a projecting configuration like that in FIG. 2, this door-mounted latch feature is shown here with a recessed configuration with a receptacle 111 that extends downwardly into the top wall of door 24 or the door upper edge from the striker plate 36. The striker 34 is shown here defined by a front and/or upper edge of the door 24 inner panel that provides the intersection between the inwardly facing surface of the inner wall and the upper edge or upwardly facing surface of the top wall of door 24 that gets contacted by the latch mechanism 30 to automatically move the various components of latch mechanism 30 into proper alignment for door closure. Latch mechanism 30 of this embodiment is shown with its components that may be enclosed by the latch mechanism housing 31 (FIG. 1), which are mostly the same as those in FIGS. 2-12, whereby those descriptions are applicable here, only differing in the following ways.

Instead of a cam-type catch that is bi-stable in two positions, the latch mechanism 30 of FIG. 13 has no over-center spring mechanism and its catch 47 is shown here as a pawl 120 that is biased downwardly toward a neutral state in a locking position or pawl lowered position to hook into the receptacle 111 that is shown here embedded in the front door panel's upper edge. The latch frame or latch base 42 is shown with two spring pockets 122 recessed into its back wall 52 that receive a pair of horizontally arranged springs 90 that push against a back wall of the catch carrier body base segment 62. This biases the swing arm or floating catch carrier 46 about the pin 56 at its floating catch carrier back or inner end 126, which pivots the floating catch carrier front or outer end 124, pivoted downwardly. A pair of floating catch carrier arms 128 extend between the inner and outer ends 124, 126 to connect the base segment 62 to the alignment blocks 64. The back portions of the alignment blocks 64 have structures that control and limit movement of the pawl 120. Receptacles 130 have top and bottom walls 132, 134 and a curved back wall 136 that collectively define a sideways generally U-shaped opening that can receive and locate respective portions of the pawl 120. A stop 138 is defined by a surface that extends down and angularly back from the top wall of the alignment blocks 64 and connects to a front edge of the receptacle top wall 132.

Still referring to FIG. 13, pawl 120 includes a pawl body 140 with front and back ends 142, 144. A pawl claw 146 extends down and rearwardly with respect to the pawl body front end 142 and has a tip 148 that is arranged farthest from the pawl body 140. A pair of lobes 150 are spaced from each other and extend rearwardly from the back wall of the pawl body 140. The pin(s) 82, about which the pawl 120 can pivot, extends outwardly from each of the lobes 150, shown here extending through and beyond the sides of the lobes 150. A translation joint 152 is defined by the interconnection of pawl 120 and the floating catch carrier 46. Within the translation joint 152, pin(s) 82 defines a translatable pivot axis about which the pawl 120 can pivot with respect to the floating catch carrier 46 while permitting longitudinal movement. Pin(s) 82 are guided within the slot(s) 80 of the translation joint 152 for longitudinal translation with respect to the floating catch carrier 46. This arrangement allows the pawl 120 both pivot up and down and move back and forth in a front to back direction within the translation joint 152.

Still referring to FIG. 13, the translation joint 152 may allow for multiple discrete maximum movement positions of the pawl 120. The example shown here may be configured to provide three discrete maximum movement positions that correspond to three states of the pawl 120. A default or resting state is defined with the pawl 120 in a retracted position and a lowered position, such as a combined retracted and lowered position. In this resting or retracted state, the pawl 120 may be stably seated within the alignment block(s) 64. The pin(s) 82 may abut the back wall of the slot 80 and the lobes 150 may be nested in the receptacles 130 so that the receptacle top and bottom walls 132, 134 prevent pivoting of the pawl 120 when retracted, restricting movement to linear movement of the pawl 120 away from the receptacle back wall 136 against the force of spring 96. In an extended state, the pawl 120 is moved forward to a maximum forward position and the pin(s) 82 may abut a front wall of the slot 80. The pawl 120 may define an extended and lowered state in which the pawl 120 is in the extended position and remains pivoted down or in the same angular orientations as it was in the retracted state. This may position the tip of the pawl claw 146 in a first position so that it extends downwardly beyond a lower surface of the floating catch carrier, such as bottom wall 68 of the alignment block 64. The pawl 120 may define an extended and raised state in which the pawl 120 is in the extended position and is pivoted up away from its position when in the lowered state. This may position the tip of the pawl claw 146 in a second position so that it is raised and points in a different direction relative to the first lowered position. To achieve this position, the pawl 120 may be pivoted up and rearward until further movement is prevented by an engagement between the pawl body 140 and the stop(s) 138 at the alignment block(s) 64.

Figure 14:
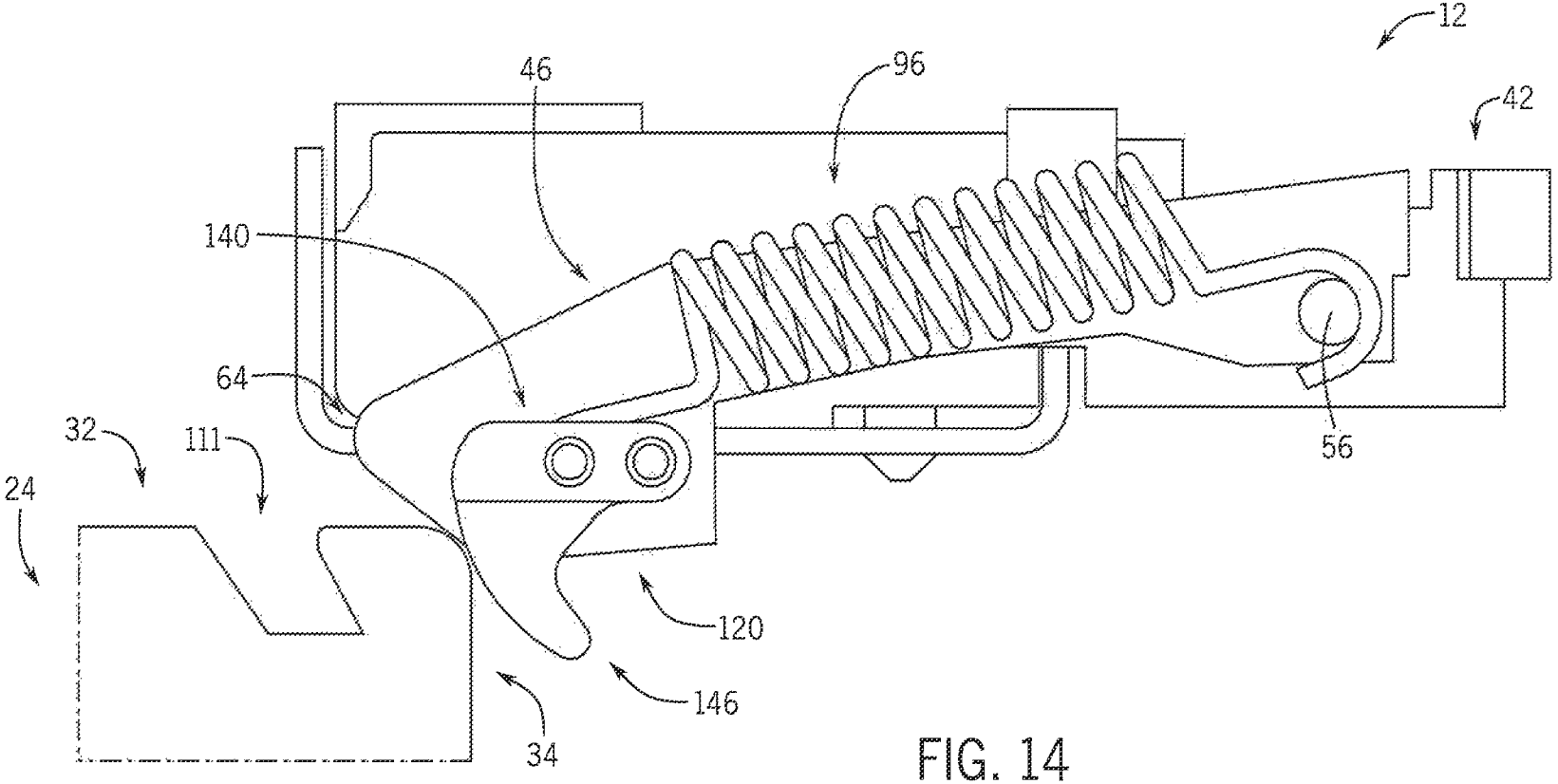
FIG. 14 is cross-sectional view of the appliance door latch system of FIG. 13 at the beginning of a latching event.
Figure 15:
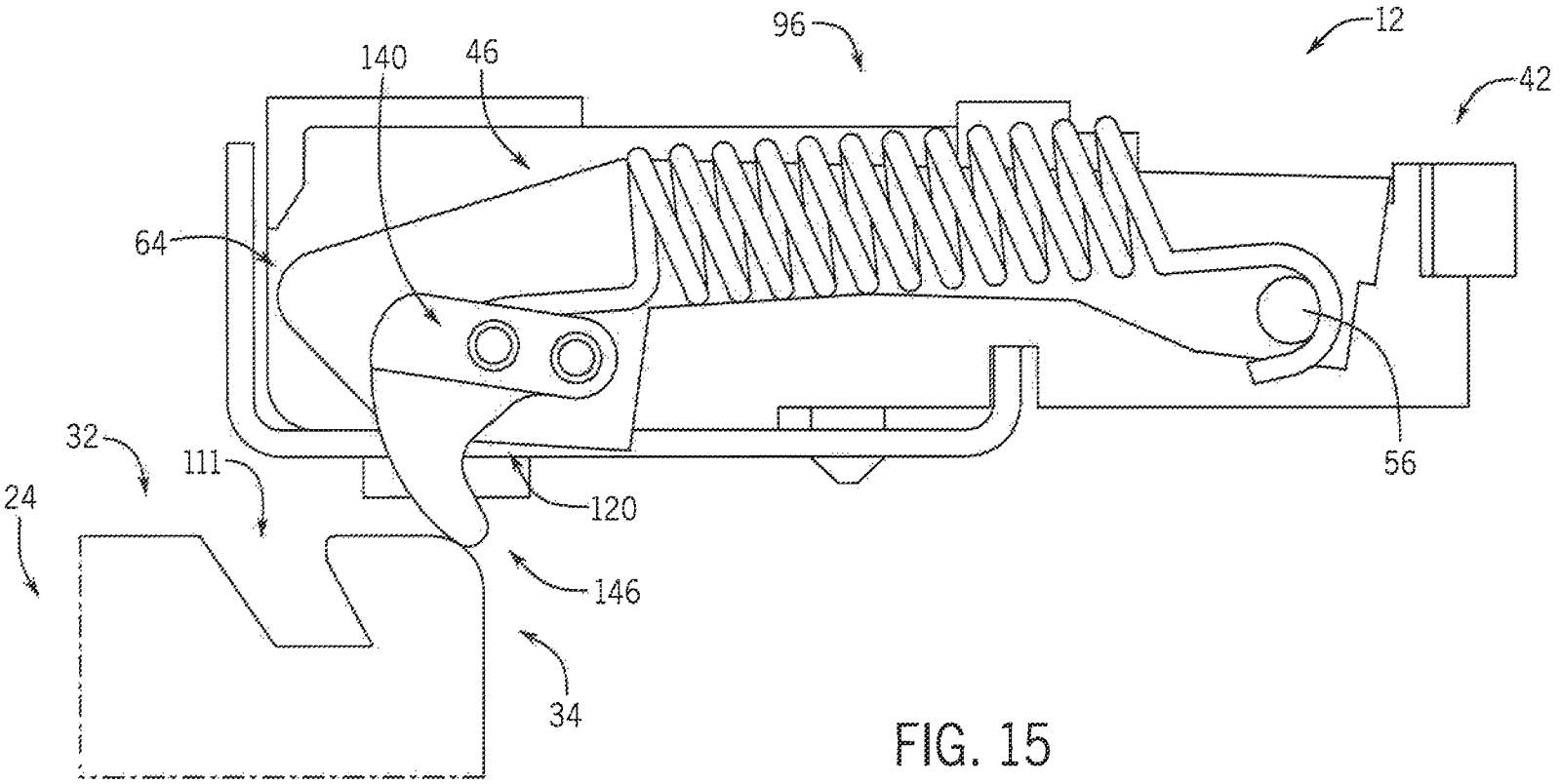
FIG. 15 is another cross-sectional view of the appliance door latch system of FIG. 13 further into the latching event.
Figure 16:
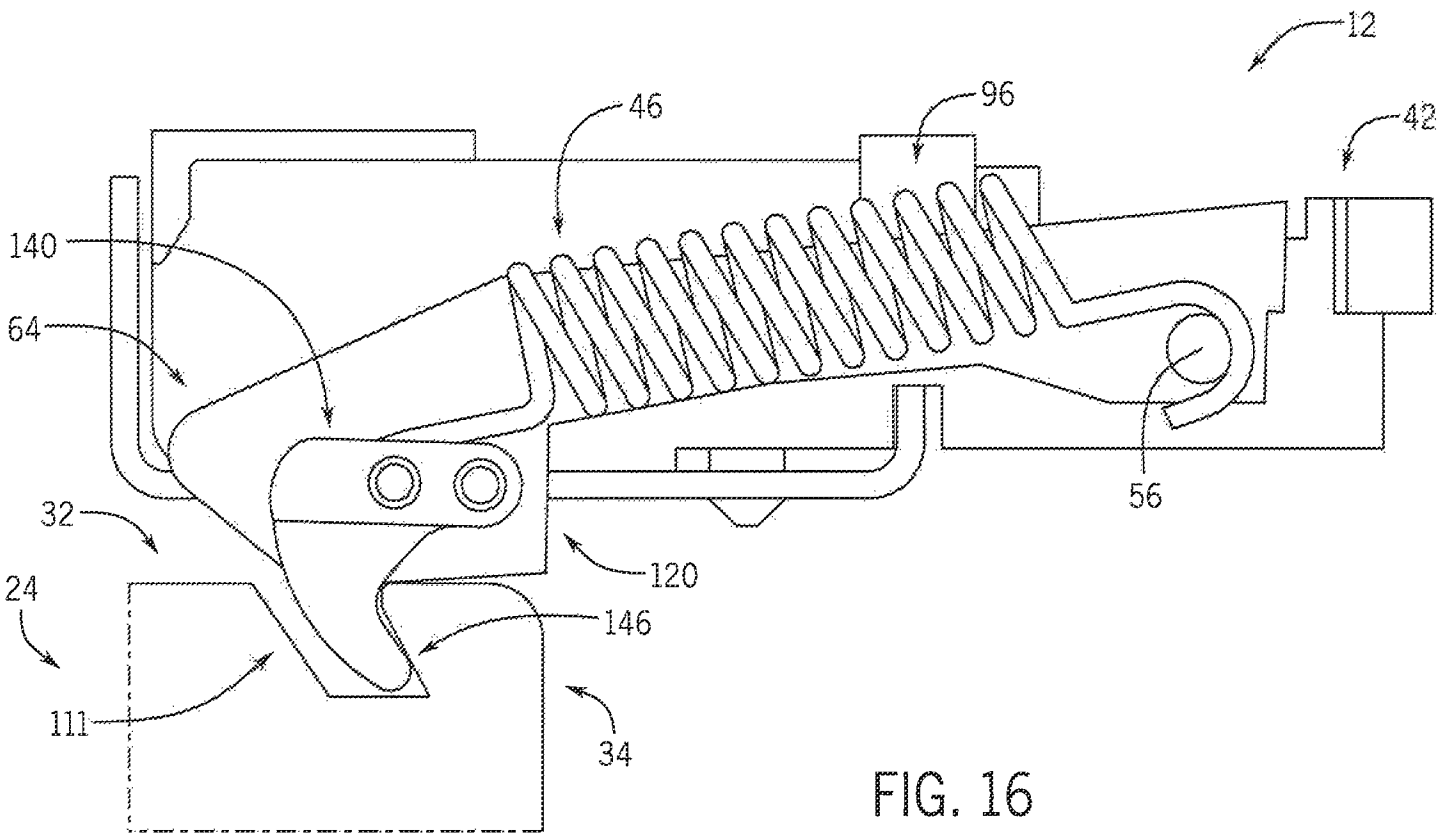
FIG. 16 is another cross-sectional view of the appliance door latch system of FIG. 13 at the end of the latching event or beginning of an unlatching event.

Referring now to FIGS. 14-16, a latching event with automatic alignment is shown with the embodiment of the latch mechanism 30 and striker assembly 32 of FIG. 13. FIG. 14 shows the floating catch carrier 46 and pawl 120 in their resting states, with the catch carrier 46 biased down and the pawl 120 biased down and back or in the pawl retracted and lowered position(s). During the latching event, initial contact occurs between the striker 34 and at least one of the floating catch carrier 46 and the pawl 120, shown here contacting angularly intersecting or overlapping surfaces of the floating catch carrier 46 and the pawl 120 substantially simultaneously. FIG. 15 shows the floating catch carrier 46 pivoted upwardly as a function of the height of the door panel upper edge relative to the pawl 120. Pawl 120 remains seated in the alignment block 64 and thus in the pawl lowered and retracted position so that the height correcting deflection is achieved through the upward pivoting of the floating catch carrier 46 while the door panel upper edge slides underneath the floating catch carrier 46 and pawl 120. FIG. 16 shows the completed latching event. The pawl 120 has been pulled down into the receptacle 111 of the door panel upper edge, with the pawl claw 146 and an angled front wall of the receptacle 111 engaging each other along an angled interface to resist both upward and rearward withdrawal of the pawl 120 from the receptacle 111 of the door panel upper edge. The floating catch carrier 46 and pawl 120 are shown in substantially the same slightly downward slanted orientation as that shown in FIG. 14 at the initial contact of the latching event, although it is understood that if more vertical height correction is required for particular implementation, the floating catch carrier 46 and pawl 120 may slant downwardly less or be closer to parallel to the latch frame or base 42.

Figure 17:
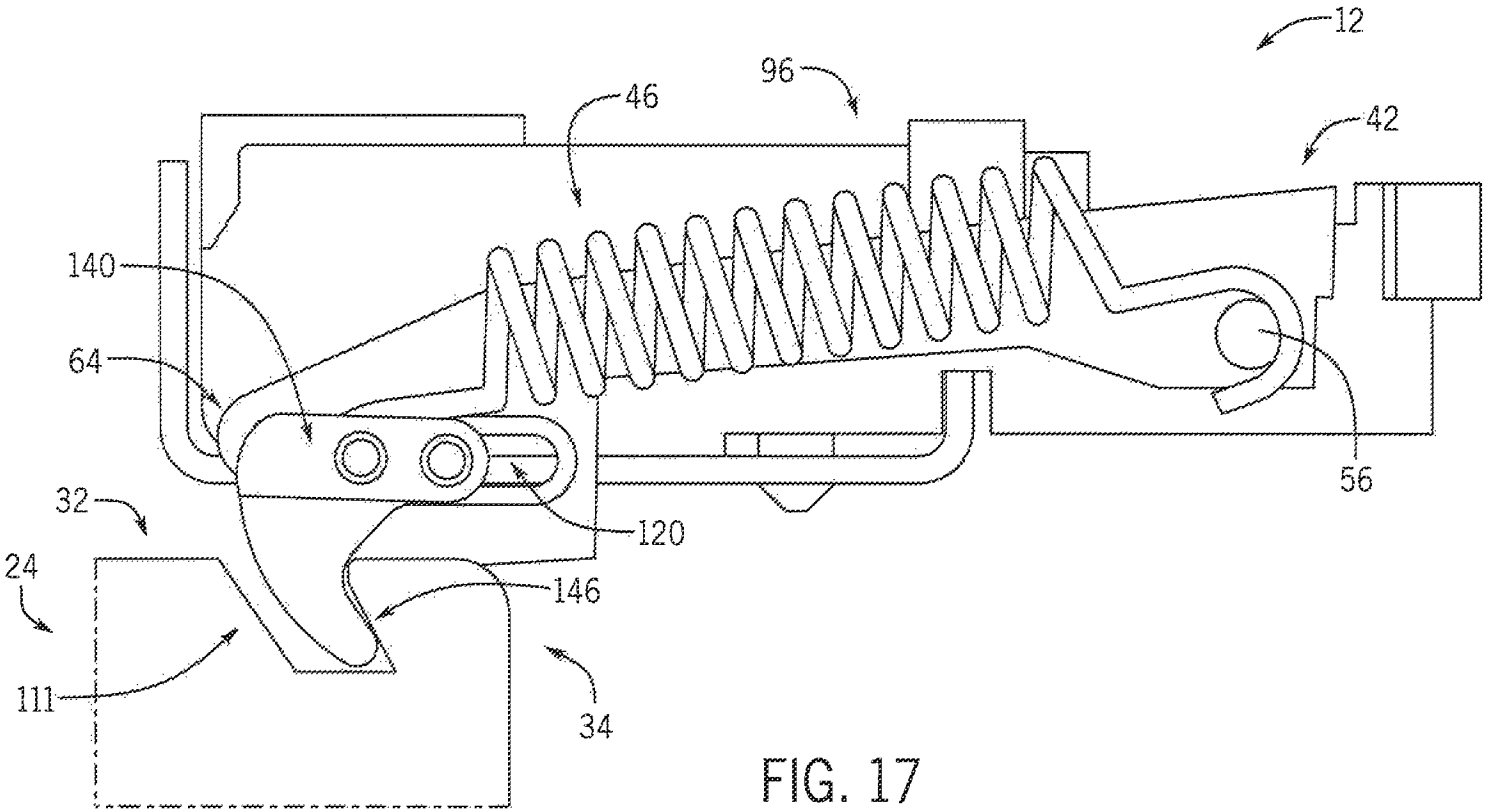
FIG. 17 is another cross-sectional view of the appliance door latch system of FIG. 13 further into the unlatching event.
Figure 18:
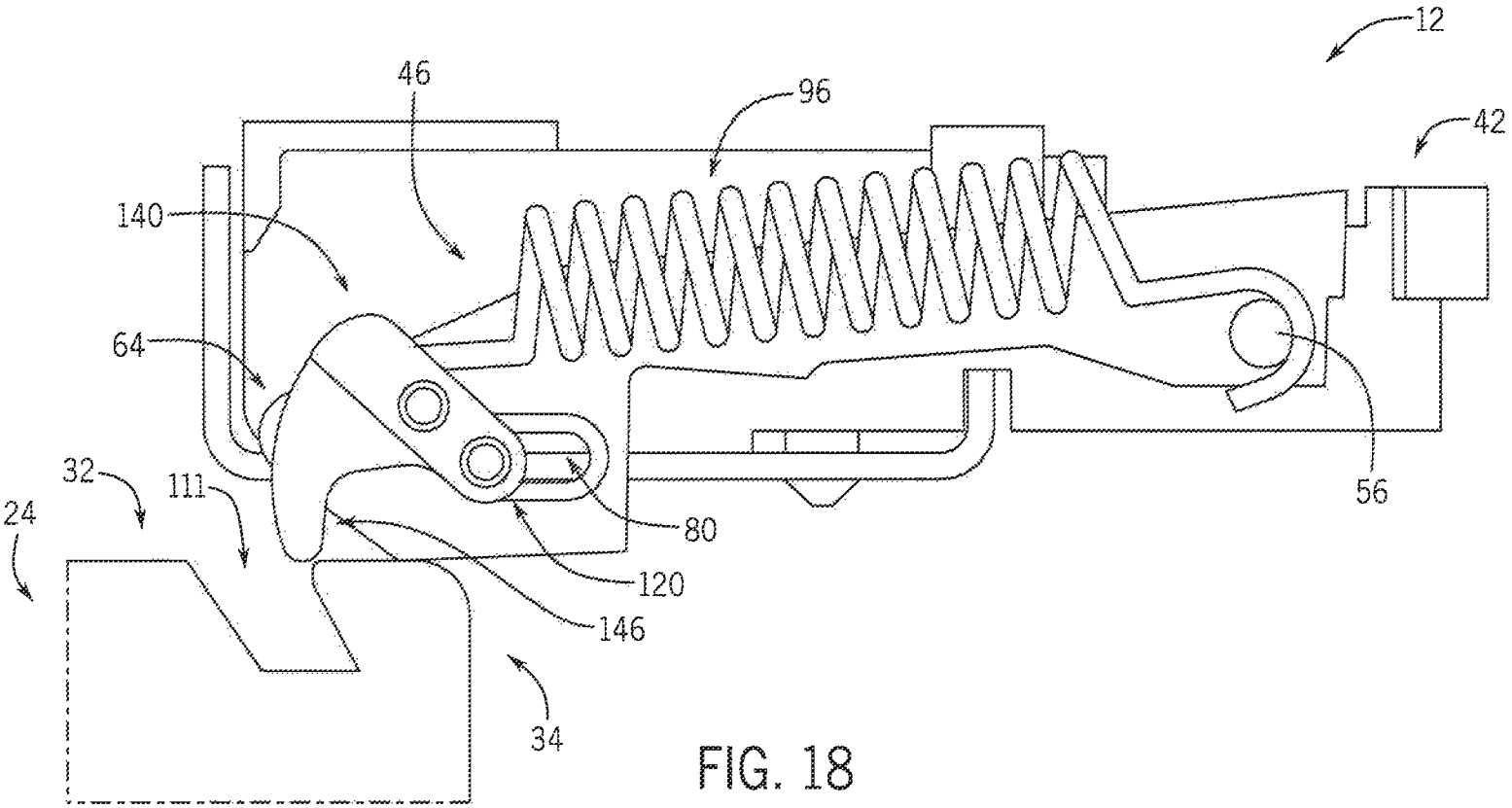
FIG. 18 is another cross-sectional view of the appliance door latch system of FIG. 13 yet further into the unlatching event.

Referring now to FIGS. 16-18, an unlatching event is shown with the embodiment of the latch mechanism 30 and receptacle 111 of FIG. 13. FIG. 16 represents the dishwasher or other appliance door 24 in its closed and latched position, from which the unlatching event is initiated. FIG. 17 shows the door 24 starting to be pulled upon during the unlatching event. Pawl 120 is unseated from its retracted position and moved linearly forward to an extended position while remaining in the lowered position, or downward, and unpivoted position. Pulling the door 24 farther open from this point moves the pawl 120 to pivot away from its lowered position to its position shown in FIG. 18. In FIG. 18, the pawl 120 is in its extended and raised state or position, with the pawl 120 as far forward in the slot 80 as permitted and pivoted upwardly as far as permitted by stop 138 (FIG. 13). Alignment block 64 is shown contacting the upper surface of the door panel upper edge, while being slid under the floating catch carrier 46 and pawl 120. After the pawl claw 146 clears and is fully withdrawn from the recess of receptacle 111 in the door panel upper edge, spring 96 biases the pawl 120 back into its seated position within the alignment block 64 and, therefore, in its retracted and lowered position. This may lever the floating catch carrier 46 upwardly, if the pawl 120 remains in contact with the upper surface of the door panel upper edge so that the floating catch carrier 46 and pawl 120 achieve a position like that shown in FIG. 15. Further opening the door 24 from that point withdraws the door 24 from contacting the pawl 120 and/or floating catch carrier 46, at which point the floating catch carrier 46 falls back down to its lowered resting state position and the floating catch carrier 46 and pawl 120 return to the state shown in FIG. 14.

Certain terminology is used herein for purposes of reference only, and, thus, is not intended to be limiting. For example, terms such as "upper", "lower", "above", and "below" refer to directions in the drawings to which reference is made. Terms such as "left", "right", "front", "back", "rear", "bottom", and "side" describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second", and other such numerical terms referring to structures do not imply a sequence or order unless clearly indicated by the context.

When introducing elements or features of the present disclosure and the exemplary embodiments, the articles "a", "an", "the", and "said" are intended to mean that there are one or more of such elements or features. The terms "comprising", "including", and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

Various features of the invention are set forth in the following claims. It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

What is claimed is:

1. An appliance door latch system of an appliance for latching an appliance door to secure the appliance door in a door closed position in which the door is held against an appliance housing to cover an appliance housing opening and for unlatching the appliance door to release the appliance door to permit movement of the appliance door away from the appliance housing to a door open position that exposes the appliance housing opening, the appliance door latch system comprising:

a door-mounted latch feature supported by and is moveable with the appliance door toward and away from the appliance housing when the appliance door is moved between the door closed and open positions;

a latch mechanism adapted to receive the door-mounted latch feature to secure the appliance door in the door closed position and release the door-mounted latch feature to release the appliance door to permit movement of the appliance door to the door open position, the latch mechanism including:

a catch that is selectively engageable with the door-mounted latch feature holding the appliance door in the door closed position; and a pre-latching catch alignment system that supports the catch and aligns the catch relative to the door-mounted latch feature while the door is moved from the door open position toward the door closed position and makes contact with the door-mounted latch feature before the catch contacts the door-mounted latch feature.

2. The appliance door latch system of claim 1, wherein the pre-latching catch alignment system includes a floating catch carrier that supports the catch and at least a portion of which is movable with respect to the appliance housing when at least one of the floating catch carrier and the catch engages the door-mounted latch feature.

3. The appliance door latch system of claim 2, wherein the floating catch carrier is spring biased to a first position against a stop and includes a sloped guide surface receiving a surface of the door-mounted latch feature to move the floating catch carrier away from the stop against the spring biasing to position the catch carrier into alignment with the door-mounted latch feature as the door is closed.

4. The appliance door latch system of claim 3, wherein the floating catch carrier includes:

a floating catch carrier outer end that faces toward the appliance door;

a floating catch carrier inner end that faces away from the appliance door; and wherein the lifting upwardly of the floating catch carrier is defined by an upward pivoting movement of the floating catch carrier outer end with respect to the appliance housing.

5. The appliance door latch system of claim 4, wherein a pivot joint is defined at the floating catch carrier inner end for providing pivoting movement between the floating catch carrier and the appliance housing to accommodate pivoting of the floating catch carrier outer end upwardly while the door-mounted latch feature passes under the floating catch carrier outer end during the appliance door latching event.

6. The appliance door latch system of claim 5, wherein:

a translation joint is defined between the catch and the floating catch carrier; and during an appliance door unlatching event in which the door-mounted latch feature is withdrawn from the latch mechanism, the catch moves along the translation joint from a retracted position farther inward of the floating catch carrier to an extended position farther outward of the floating catch carrier.

7. The appliance door latch system of claim 2, wherein the catch provides a pawl that includes:

a pawl body that is connected to the floating catch carrier; and a pawl claw that extends from the pawl body and selectively engages the door-mounted latch feature to latch the appliance door in the door closed position.

8. The appliance door latch system of claim 7 wherein the pawl is movable between:

a pawl lowered position in which a tip of the pawl claw extends downwardly beyond a lower surface of the floating catch carrier to define a first tip position; and a pawl raised position in which the tip of the pawl claw defines a second tip position that is raised relative to the first tip position.

9. The appliance door latch system of claim 8, wherein movement of the pawl from the pawl lowered position to the pawl raised position is defined by an upward pivoting movement of the pawl with respect to the floating catch carrier.

10. The appliance door latch system of claim 9, wherein the pawl is biased toward the pawl lowered position.

11. The appliance door latch system of claim 7, wherein the pawl is movable between:

a pawl retracted position in which the pawl body is arranged relatively farther inward relative to the appliance housing; and a pawl extended position in which the pawl body is arranged relatively farther outward relative to the appliance housing.

12. The appliance door latch system of claim 11, wherein a translation joint is defined between the pawl and the floating catch carrier that is adapted to allow relative movement between the pawl and the floating catch carrier and guide the movement of the pawl between the pawl retracted and extended positions.

13. The appliance door latch system of claim 12, wherein the translation joint includes a slot that extends longitudinally along the floating catch carrier and provides a pathway along which the pawl is movable while moving between the pawl retracted and extended positions.

14. The appliance door latch system of claim 13, wherein the translation joint includes a pin that extends transversely through and is longitudinally movable within the slot in the floating catch carrier and connects the pawl to the floating catch carrier so that the pawl and pin move in unison longitudinally along the slot in the catch carrier.

15. The appliance door latch system of claim 14, wherein the pin of the translation joint defines a pivot axis of the pawl so that the pawl is urged into both a translation movement toward the pawl extended position and a pivot movement during an appliance door unlatching event in which the striker is withdrawn from the latch mechanism.

16. The appliance door latch system of claim 9, wherein the pawl is biased toward the pawl retracted position.

17. A dishwasher comprising:

a dishwasher housing providing an opening for accessing an interior of the dishwasher;

a door movable between a door closed position in which the door covers the dishwasher housing opening and a door open position in which the door is moved away from the dishwasher housing to uncover the dishwasher housing opening;

a door-mounted latch feature mounted to the door for holding the door in the door closed position;

a height-correcting latch mechanism adapted to receive the door-mounted latch feature to secure the door in the door closed position and release the door-mounted latch feature to release the door to permit movement of the door to the door open position, the height-correcting latch mechanism including:

a catch that is selectively engageable with the door-mounted latch feature for holding the door in the door closed position and moveable to release the door to the door open position; and a floating catch carrier that supports the catch and at least a portion of which is movable with respect to the dishwasher housing, the floating catch carrier including a guide surface arranged outwardly of the catch to contact, engage and slide with respect to the door-mounted latch feature during a door latching event in which the door-mounted latch feature is inserted into the latch mechanism to automatically provide height adjustment of the catch to vertically align the catch with the door-mounted latch feature before a contact event between the catch and the door-mounted latch feature.

18. The dishwasher of claim 17, wherein the floating catch carrier is pivot mounted relative to the dishwasher housing and biased downwardly so that the vertical alignment of the catch with the door-mounted latch feature is provided by the catch carrier pivoting upwardly in response to engagement of the door-mounted latch feature and at least one of the catch and the floating catch carrier while the door-mounted latch feature slides under the catch carrier during the latching event.

19. The dishwasher of claim 18, wherein the floating catch carrier defines an inner pivot joint at which the floating catch carrier can pivot with respect to the dishwasher housing and an outer pivot joint at which the catch can pivot with respect to the floating catch carrier away from a resting state position to accommodate at least one of the door latching event in which the door-mounted latch feature is inserted into the latch mechanism and a door unlatching event in which the door-mounted latch feature is withdrawn from the latch mechanism.

20. The dishwasher of claim 19, wherein the floating catch carrier includes a slot and the catch is movably mounted with respect to the slot providing movable mounting of the catch to the floating catch carrier to accommodate longitudinal translational movement of the catch along the slot.

* * * * *